United States Patent [19]

Satoh et al.

[11] 4,394,165

[45] Jul. 19, 1983

[54] METHOD OF PRELIMINARY DESILICONIZATION OF MOLTEN IRON BY INJECTING GASEOUS OXYGEN

[75] Inventors: Shingo Satoh; Takashi Inoue; Minoru Naki; Yuji Kawauchi, all of Muroran, Japan

[73] Assignee: Nippon Steel Corporation, Japan

[21] Appl. No.: 325,999

[22] Filed: Nov. 30, 1981

[30] Foreign Application Priority Data

Aug. 19, 1981 [JP] Japan ..... 55-129609

[51] Int. Cl.[3] ..... C21C 7/00

[52] U.S. Cl. ..... 75/60; 75/59

[58] Field of Search ..... 75/59, 60

[56] References Cited

U.S. PATENT DOCUMENTS 2,793,110 5/1957 Kosmider ..... 75/60

FOREIGN PATENT DOCUMENTS 53-78913 5/1978 Japan ..... 75/60

54-158321 8/1979 Japan ..... 75/60

*Primary Examiner*—P. D. Rosenberg

*Attorney, Agent, or Firm*—Wenderoth, Lind & Ponack

[57] ABSTRACT

The present invention provides a method for preliminary treatment of molten iron from a blast furnace wherein only desiliconization of the iron is effected. Gaseous oxygen is injected into the molten iron by controlling its supply rate depending on the Si content of the molten iron in such a manner that said rate is increased if the Si content of the iron is high and decreased if the Si content is low.

11 Claims, 8 Drawing Figures

METHOD OF PRELIMINARY DESILICONIZATION OF MOLTEN IRON BY INJECTING GASEOUS OXYGEN

BACKGROUND OF THE INVENTION

The present invention relates to a method of preliminary desiliconization of molten iron from a blast furnace in steelmaking. More particularly, the invention relates to a method wherein molten iron from a blast furnace, before it is charged into a converter (oxygen blowing steelmaking furnace), is desiliconized in a melt stream such as runner or pouring basin or in a container such as mixer ladle car or ladle, and subsequently, the iron is subjected or not subjected, to dephosphorization and desulfurization before it is charged into the converter where it is primarily subjected to decarburization. The preliminary desiliconization of the molten iron is hereunder referred to as preferential desiliconization of the melt. In the present invention, the melt is desiliconized by injecting gaseous oxygen into the melt.

DESCRIPTION OF THE PRIOR ART

A typical example of the process for converting molten iron from a blast furnace into molten steel is the basic oxygen converter process which comprises blowing oxygen onto the molten iron in the presence of basic slag to achieve simultaneous reduction of the C, Si, P and S contents of the slag to the desired levels. However, the converter process involves an oxidation which performs decarburization, desiliconization and dephosphorization simultaneously in the converter, and accordingly, high bath and atmospheric temperatures are generated. The dephosphorization reaction proceeds at relatively low temperatures, and to accomplish efficient dephosphorization, the slag formation must be controlled while its basicity is held high. But due to desiliconization, silicon is first oxidized in to silicic anhydride ($SiO_2$) which thereby reduces the basicity of the slag and inhibits dephosphorization. Therefore, to achieve the proper control of the slag basicity, a flux such as CaO must be used in a large quantity, and this results in the formation of as much as 120 to 150 kg of slag per ton of the pig. Steel making operations in the presence of much slag often causes slag foaming or slopping, and to prevent such unwanted effects, a large capacity converter must be used, resulting in an increase in the cost of the steel mill. Besides, the discharge of much slag increases the load and operating cost of a recovery or regenerating system, and in addition, the limited use of slag makes a large slag dumping yard necessary. The formation of much slag also means low iron yield because the slag contains about 20% of FeO (which includes a little amount of $Fe_2O_3$). What is more, the high slag content causes early damages to the furnace refractory and complicates the converter operation, causing various problems such as low quality molten steel due to its absorption of hydrogen from the flux and to its increased oxygen content as well as the need of addition of ferroalloy and low steel yield.

Recent studies on effective steelmaking are focused on the possible usefulness of preliminary desiliconization of molten iron to be converted to steel. The present inventors were among those who first confirmed the usefulness of this technique, and incorporated it in actual steel-making operations. As a result, the inventors developed a new process comprising the step of preferential desiliconization of molten iron and the step of dephosphorization and decarburization in the oxygen steelmaking furnace, and this process has put the inventors in an advantageous position in their efforts to reduce the slag formation appreciably, cut the cost of auxiliary materials such as CaO, and iron loss, as well as save energy consumption in steelmaking and develop an effective method of waste disposal. As will be described in detail herein, the present inventors have proposed two basic methods of preferential desiliconization of molten iron—supplying solid iron oxides, and supplying gaseous oxygen from above the molten bath.

The present invention relates to a further improvement in the preferential desiliconization of molten iron that has been accomplished as a result of the continued R&D efforts of the present inventors on steelmaking. In preferential desiliconization of molten iron, the oxidation of carbon and manganese in the melt must be inhibited as much as possible since the carbon is used as a heat source for the subsequent dephosphorization and decarburization and manganese is a valuable component and its loss must be reduced to minimum. In other words, only silicon must be removed by oxidation. At the same time, the heat loss during preferential desiliconization must also be reduced to minimum in order to achieve the desired heat control and optimum selection of input charges in the overall steelmaking process.

To meet this object, the present inventors filed Japanese patent application (OPI) No. 158321/79 (the symbol OPI as used herein means an unexamined published Japanese patent application), in which they proposed that if solid iron oxides are used in preferential desiliconization, they be supplied at a controlled rate depending upon the composition of the iron oxides. They also filed Japanese patent application (OPI) No. 78913/78 in which they stated that if gaseous oxygen is blown onto the molten iron in preferential desiliconization, it is effectively supplied at a rate not greater than 2.5 $Nm^3$/min per ton of the pig. But as will be discussed herein, the use of solid iron oxides causes great heat loss due to their melting and decomposition, and the blowing of gaseous oxygen accelerates oxidation of carbon or manganese, so it has been difficult to achieve the desired preferential desiliconization by either method.

SUMMARY OF THE INVENTION

Therefore, one object of the present invention is to provide a more effective method of preferential desiliconization of molten iron.

Another object of the present invention is to perform satisfactory preferential desiliconization of molten iron so as to minimize the slag formation that accompanies the production of molten steel in a converter and solve all the problems that are caused by the slag.

A further object of the present invention is to desiliconize molten iron by injecting gaseous oxygen into the melt, so as to eliminate two main defects of the conventional method, i.e. low melt temperature and low oxygen utility in desiliconization.

Still another object of the present invention is to provide a method that is particularly adapted to preferential desiliconization of high silicon molten iron.

These objects and accompanying advantages of the present invention are achieved by any one of the following methods.

1. A method of preferential desiliconization of molten iron by injecting gaseous oxygen wherein the gaseous oxygen is blown into the molten iron at a rate of $V_{O2} \geqq 0.03$ $Nm^3$/min per ton of the pig, said rate being controlled depending upon the silicon content of the molten iron so as to satisfy the formula (I):

$$V_{O2} \leqq 1.24\,[\%Si] - 0.075 \quad \text{(I)}$$

where $V_{O2}$: the rate of gaseous oxygen feed ($Nm^3$/min/ton pig, and [%Si]: Si content of the molten iron (%).

2. A method according to Paragraph 1 wherein the rate of gaseous oxygen feed $V_{O2}$ is controlled depending upon the silicon content of the molten iron so as to satisfy the formulae (II) and (III):

$$V_{O2} \leqq 0.80\,[\%Si] - 0.075 \quad \text{(II)}$$

$$V_{O2} \geqq 0.16\,[\%Si] - 0.01 \quad \text{(III)}$$

3. A method according to Paragraph 1 or 2 wherein the rate of gaseous oxygen feed $V_{O2}$ is reduced in increments or continuously.

4. A method according to any one of the preceding paragraphs 1 to 3 wherein the gaseous oxygen is supplied through a lance immersed in the molten iron to a depth of at least 200 mm.

5. A method according to any of the preceding paragraphs 1 to 4 wherein the gaseous oxygen is supplied through a consumable lance.

6. A method according to any of the preceding paragraphs 1 to 5 wherein the energy for agitating the molten iron is controlled by varying the amount of a protective coolant that is used to protect the immersed lance from elevated temperatures.

7. A method according to any of the preceding paragraphs 1 to 6 wherein an agitating gas is mixed with the gaseous oxygen supplied for desiliconization.

8. A method according to any of the preceding paragraphs 1 to 7 wherein the agitating gas is blown from the bottom and/or side of a container which contains the molten iron being desiliconized.

9. A method according to any of the preceding paragraphs 1 to 8 wherein the energy of mechanical agitation is used to further increase the oxygen utility in preferential desiliconization.

10. A method according to any of the preceding paragraphs 1 to 9 wherein a coolant is used to control the temperature of the molten iron being desiliconized.

11. A method according to any of the preceding paragraph 10 wherein solid iron oxide is used as the coolant.

BRIEF DESCRIPTION OF THE DRAWINGS

FIG. 5(*b*) is a graph showing the relation between the amount of silicon removed by solid iron oxide and the temperatures before and after the desiliconization;

PREFERRED EMBODIMENTS OF THE INVENTION

The present inventors started from the assumption that preferential desiliconization can be accelerated without heat loss by using gaseous oxygen and supplying it in a proper manner. As a result of studies on various methods of supplying gaseous oxygen, they have found that if gaseous oxygen is supplied from above as in the conventional process, about 5 to 15% of oxygen is lost without entering the desired desiliconization, and that this oxygen loss is the primary cause of inhibiting the preferential desiliconization. Based on this finding, the present inventors devised a technique wherein gaseous oxygen is injected directly into the molten iron. According to the present invention, gaseous oxygen is directly injected into the molten iron at a rate ($V_{O2}$) of at least 0.03 $Nm^3$/min per ton of the pig which is controlled depending upon the silicon content of the melt by the formula (I):

$$V_{O2} \leqq 1.25\,[\%Si] - 0.075 \quad \text{(I)}$$

where $V_{O2}$: rate of gaseous oxygen feed ($Nm^3$/min/t.p.); and [%Si]: Si content of the molten iron (%). By this method, the heat loss during the desiliconization of the molten iron is inhibited, and the CO reaction is inhibited by the static pressure of the molten steel to further accelerate the preferential desiliconization of the molten iron.

Figure 4:
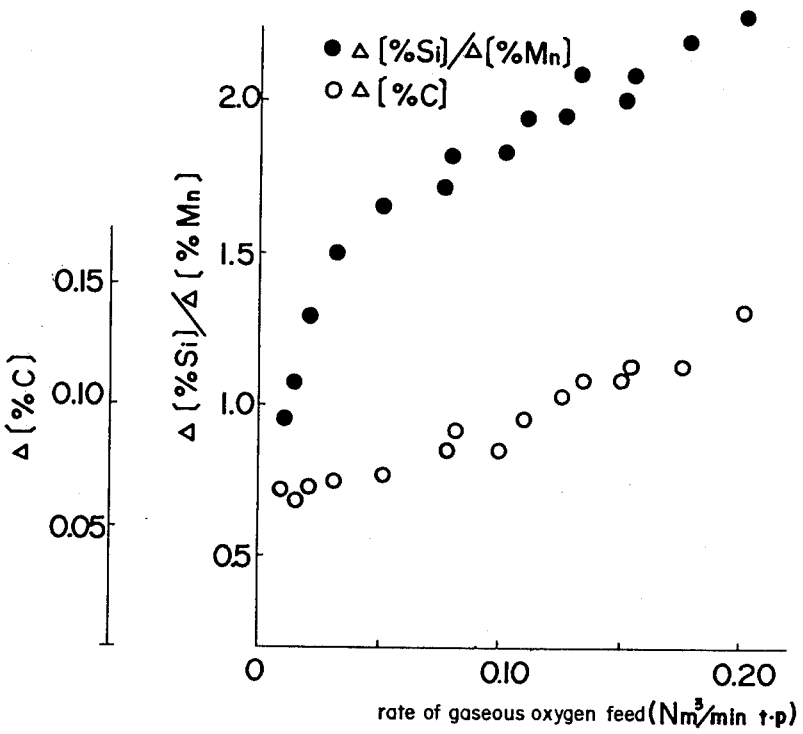
FIG. 4 is a graph showing the relation of the rate of gaseous oxygen feed, the amount of silicon eliminated in preference to manganese and the amount of carbon eliminated.
Figure 5A:
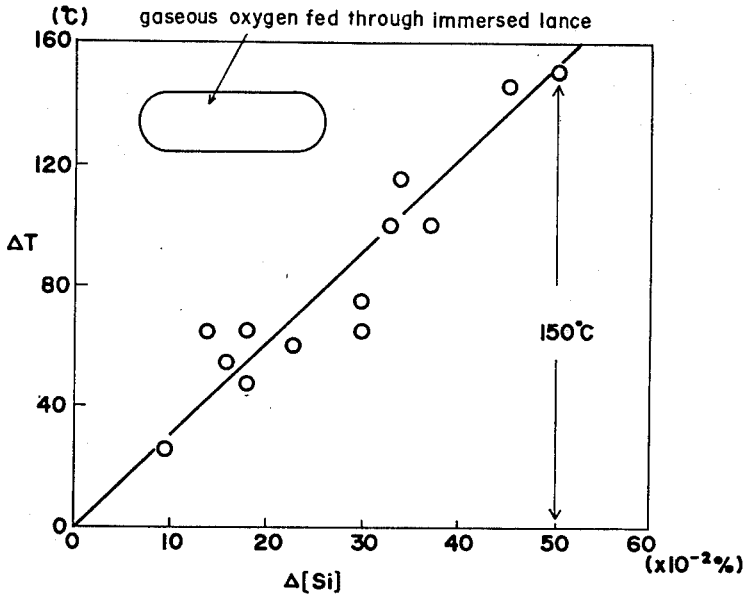
FIG. 5(*a*) is a graph showing the relation between the amount of silicon removed by gaseous oxygen and the temperatures before and after the desiliconization.
Figure 5B:
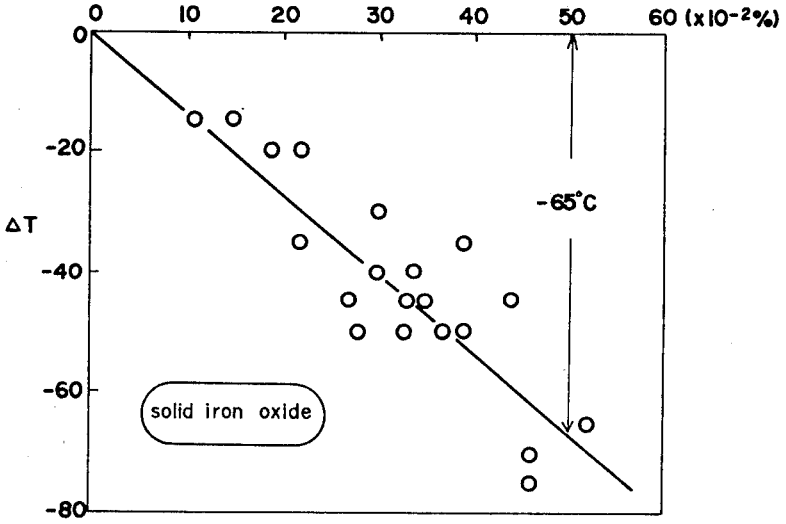

The criticality of the lower limit (0.03 $Nm^3$/min/t.p.) of the rate of gaseous oxygen feed is described hereunder. FIG. 4 shows the relation of the rate of gaseous oxygen feed, the amount of silicon removed in preference of manganese ($\Delta$[%Si]/$\Delta$[%Mn]) and the amount of carbon removed. FIG. 5(*a*) shows the relation between the rate of gaseous oxygen feed and the temperatures before and after the desiliconization, and FIG. 5(*b*) shows the relation between the rate of solid iron oxide feed and the temperatures before and after the desiliconization. The three figures are based on the data obtained by desiliconizing 60 tons of molten iron which contained 0.52 to 0.60% of silicon, 0.48 to 0.55% of manganese and 4.45 to 4.75% of carbon and which had a temperature of 1350° to 1360° C. After the desiliconization, the silicon content was reduced to 0.40 to 0.50%. Gaseous oxygen was injected into the molten iron through a lance comprising a 13 Cr stainless steel nozzle (ID: 6–15 mm) clad with a castable refractory. The lance was immersed in the molten metal to a depth of 500 to 1000 mm. As shown in FIG. 4, if gaseous oxygen is injected into the molten iron directly, the amount of carbon removed is increased in proportion to the oxygen supply rate, but the increase is by only about 0.05 to 0.15% which is almost the same as the increase resulting from the use of solid iron oxides. On the other hand, the removal of manganese is inhibited as the gaseous oxygen feed rate is increased, and if the rate is 0.03 $Nm^3$/min/t.p. or more, the ratio of the removed silicon to manganese ($\Delta[\%Si]/\Delta[\%Mn]$) is at least 1.5 which is the same as the value obtained by using solid iron oxides. Therefore, gaseous oxygen must be supplied at a rate of 0.03 $Nm^3$/min/t.p. or more to achieve the desired preferential desiliconization. The removal of manganese is inhibited as the rate of gaseous oxygen feed is increased probably because the manganese monoxide (MnO) once formed by oxygen injecting is reduced by Si in the high-temperature range in the reaction zone of oxygen injection. The more oxygen injected into the molten iron, the higher the temperature of the reaction zone and the more accelerated the reduction of MnO, with the result that the removal of manganese is inhibited.

Figure 6:
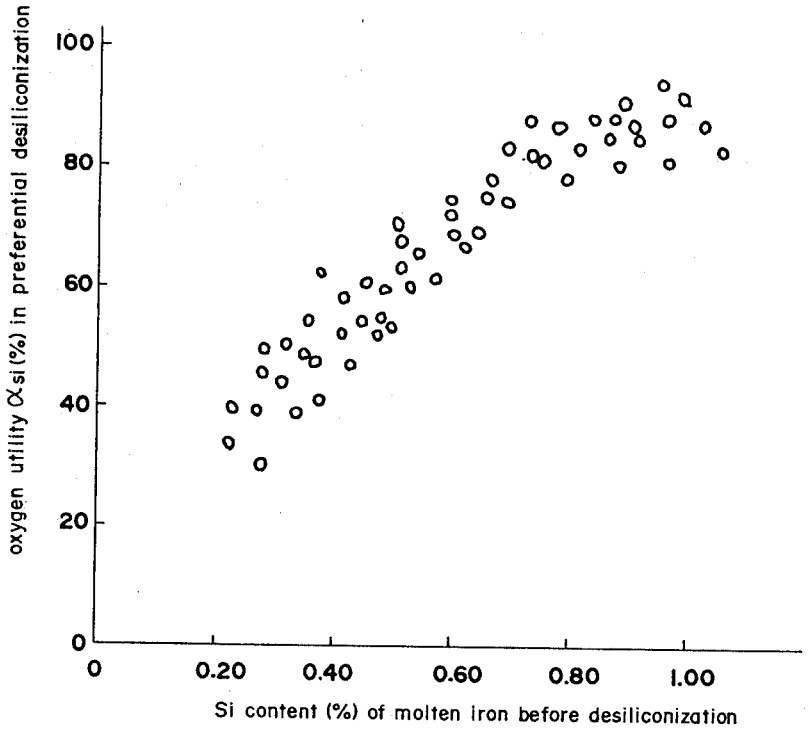
FIG. 6 is a graph showing the relation between the silicon content (%) of the molten iron before desiliconization and the oxygen utility in preferential desiliconization according to the present invention.

The criticality of the upper limit of the rate of gaseous oxygen feed is now described. As already mentioned, the gaseous oxygen must be supplied at a rate of at least 0.03 $Nm^3$/min/t.p. for the primary purpose of inhibiting the loss of manganese. But as FIG. 6 shows, even if gaseous oxygen is fed at a constant rate, the oxygen utilization in preferential desiliconization (the ratio of oxygen spent for oxidation of silicon to the total oxygen supplied) is decreased if the molten iron to be desiliconized has low silicon content. The study of the present inventors has revealed that if the oxygen utilization in desiliconization is less than 40%, rapid decarburization occurs and the resulting boiling of the molten iron makes the subsequent treatment in a mixer ladle car or ladle difficult.

FIG. 6 shows the relation between the silicon content (%) of molten iron and the oxygen utility in preferential desiliconization according to the present invention. The figure is based on the data obtained by desiliconizing 60 tons of molten iron with a silicon content of 0.20 to 1.10% by blowing 0.16 $Nm^3$ of gaseous oxygen per minute per ton of the pig through a lance immersed in the molten iron to a depth of 700 to 1000 mm. The lance had a sheathed nozzle, and gaseous oxygen was fed through the inner tube and nitrogen gas for cooling (or protecting) the nozzle was fed through the space between the inner and outer tubes at a rate of 0.03 to 0.05 $Nm^3$/min/t.p. After the treatment, the silicon content was reduced to 0.07 to 0.12%.

Figure 7:
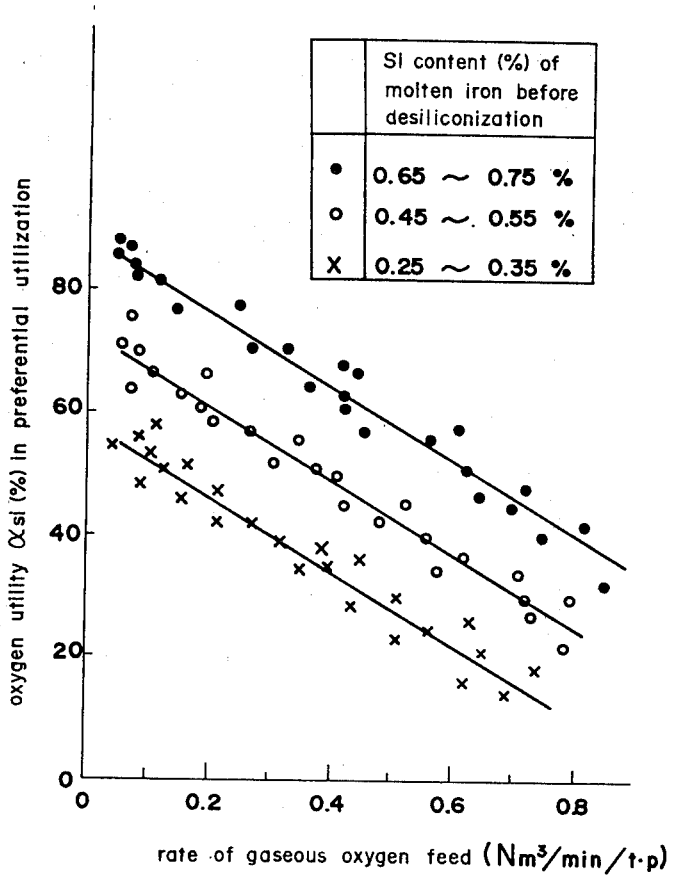
FIG. 7 is a graph showing the effect of the silicon content (%) before desiliconization on the relation between the rate of gaseous oxygen feed and the oxygen utility in preferential desiliconization.

Based on the data shown in FIGS. 4, 5(*a*) and (*b*) and 6, the present inventors started a study to develop a technique for maintaining the oxygen utilization in preferential desiliconization at 40% or higher. The point was how to reduce the decarburization speed in the low Si range. The present inventors noted the effectiveness of adjusting the rate of gaseous oxygen feed to a proper range. If gaseous oxygen is injected into the molten iron, the temperature of the melt is increased locally, and decarburization occurs in the low Si range more easily than when solid iron oxides are used or gaseous oxygen is blown onto the molten iron. This can be prevented and only silicon can be oxidized by reducing the rate of gaseous oxygen feed as the silicon content is decreased. At a melt temperature of 1600° C. or lower, oxygen has greater affinity for silicon than for carbon, and with insufficient oxygen supply, Si can be oxidized in preference to carbon. Based on this metallurgical knowledge, the present inventors desiliconized 60 tons of molten iron in a ladle to examine the relation between the silicon content of the molten iron and the proper rate of gaseous oxygen feed. The result is shown in FIG. 7 which shows that three clearly different co-relations between the gaseous oxygen supply rate ($V_{O2}$) and the oxygen utilization for preferential desiliconization ($\alpha_{Si}$) are obtained depending upon the Si content of the molten iron. FIG. 7 also shows that to maintain at least 40% of $d_{Si}$, $V_{O2}$ must be controlled to satisfy the following relations:

$V_{O2} \leqq 0.80$ $Nm^3$/min/t.p. for a Si content of 0.70±0.05%;

$V_{O2} \leqq 0.55$ $Nm^3$/min/t.p. for a Si content of 0.50±0.05%;

$V_{O2} \leqq 0.30$ $Nm^3$/min/t.p. for a Si content of 0.30±0.05%.

These relations are represented by the formula (I):

$$V_{O2} \leqq 1.25\,[\%Si] - 0.075 \qquad \text{(I)}$$

where in $V_{O2}$: rate of gaseous oxygen feed ($Nm^3$/min/t.p.) and (%SI): Si content (%) of molten iron. The data shown in FIG. 7 was obtained by repeating the experiment conducted to obtain the data illustrated in FIG. 6; the only difference was that gaseous oxygen was supplied at a rate of 0.03 to 0.8 $Nm^3$/min/t.p. and the silicon content was reduced to 0.08 to 0.11% after the desiliconization. If desiliconization is performed by injecting gaseous oxygen into the molten iron through an immersed lance, a consistent operation with an oxygen utilization of 40% or more can be achieved by controlling the rate of gaseous oxygen feed to satisfy the formula (I) depending upon the silicon content of the molten iron.

In a preferred embodiment, the rate of gaseous oxygen feed ($V_{O2}$) is controlled depending upon the Si content of the molten iron to satisfy the formulae (II) and (III):

$$V_{O2} \leqq 0.80[\%Si] - 0.075 \qquad \text{(II); and}$$

$$V_{O2} \geqq 0.16\,[\%Si] - 0.01 \qquad \text{(III).}$$

The criticality of using the formulae (II) and (III) as the upper and lower limits of the gaseous oxygen supply rate is described below.

As mentioned already, if the oxygen utility in preferential desiliconization is less than 40%, the boiling of the molten iron occurs and the subsequent treatment in a mixer ladle car or ladle becomes difficult. This is why the upper limit of the gaseous oxygen supply rate is defined by the formula (I). But as a result of many experiments, the present inventors have learned that if the formula (II) is satisfied, the boiling of the molten iron can be completely prevented and a consistent operation can be achieved in spite of the fluctuating process parameters that will accompany commercial operations. The formula (III) defining the lower limit is also dictated by the experience of the present inventors. If the gaseous oxygen feed rate is too low, a longer time is required to perform desiliconization and the temperature of the molten iron drops during the treatment, and heat loss occurs contrary to the objects of the present invention. This is conspicuous when the molten iron being desiliconized has high Si content. The extended duration of desiliconization is also incompatible with high productivity.

In the most preferred embodiment, $V_{O2}$ is reduced in increments or continuously, and this is effective for shortening the duration of desiliconization and maintaining high oxygen utility. As discussed in the preveious pages, the oxygen supply rate ($V_{O2}$) is desirably adjusted to an optimum range depending upon the Si content of the molten iron, so it is most preferred to monitor the decreasing the Si content of the molten iron being desiliconized and inject an optimum amount of gaseous oxygen. To meet this requirement, a sample is taken from the molten iron at intervals and its Si content is checked to see if the gaseous oxygen is being supplied at the proper $V_{O2}$, and if not, a correction is made to obtain the proper value. If the $V_{O2}$ is preset to a certain level depending upon the Si content before treatment, the subsequent change in the Si content can be estimated beforehand, and therefore, it is possible to perform desiliconization by supplying gaseous oxygen at a continuously decreasing rate. Alternatively, the gaseous oxygen may be supplied at a rate that is decreased in increments at given intervals. The proper method may be selected depending upon the specific conditions of commercial operations.

As shown in FIG. 5(*a*), the temperature of the molten iron being desiliconized by injecting gaseous oxygen is increased in proportion to the amount of silicon removed, and unlike solid oxygen (FIG. 5(*b*)), gaseous oxygen does not reduce the temperature of the molten iron being desiliconized. But as more silicon is removed, the temperature of the molten iron is increased too much, and inhibition of decarburization, another object of the present invention, becomes difficult. Furthermore, if the temperature of the molten iron becomes excessively high, the refactory on the vessel and lance may be eroded, so a coolant is preferably added to the molten iron to prevent it from becoming excessively hot. Preferred coolants are scrap, limestone, iron ores, mill scale, sintered ores, pellets and iron sand. For effective desiliconization, solid iron oxides such as iron ores, mill scale, sintered ores, pellets and iron sand are particularly preferred.

Figure 1:
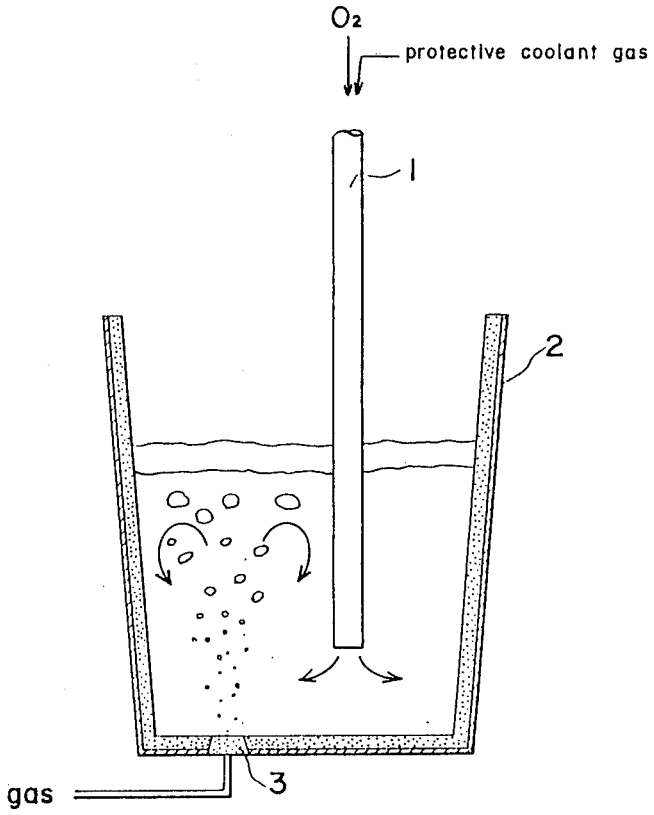
FIG. 1 is a schematic representation of one embodiment of the method of the present invention wherein molten iron is desiliconized in a ladle.
Figure 2:
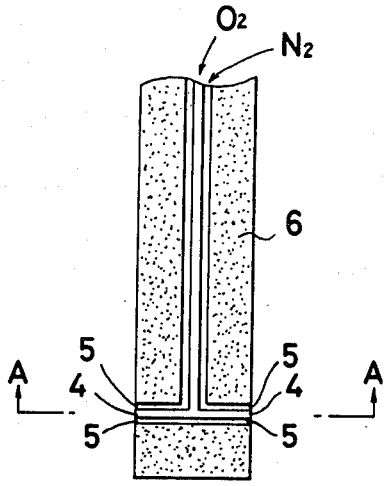
FIG. 2 is a partial enlarged longitudinal view of the tip of a lance to be immersed in the molten iron for injecting gaseous oxygen into the molten iron.
Figure 3:
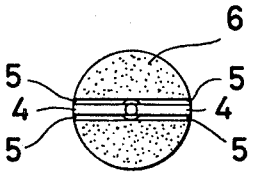
FIG. 3 is a cross section of FIG. 2 taken on the line A—A.

According to the present invention, gaseous oxygen may be blown into the molten iron through an immersed lance. If the lance is immersed less than 200 mm deep from the surface of the bath, the refining effect of the injected oxygen is not enough to inhibit the CO reaction and the desired preferential desiliconization may not be achieved. What is more, slopping of the molten iron will occur to increase the iron loss. Therefore, the lance is desirably immersed to a depth of at least 200 mm. A consumable lance is advantageous because this is less costly and easy to handle. The consumable lance should not have adverse effects on the composition of the molten iron if it is dissolved in the molten iron, and suitable examples are steel pipes that may be clad with a refractory. As the lance is consumed by some length during desiliconization, it is lowered by the same length to thereby permit continued oxygen blowing. The lance may be made of an oxygen conduit that is clad with a castable refractory, and this type has particularly great resistance to high temperatures. Any composition of castable refractory can be used, but $Al_2O_3$ refractories are especially suitable. To prevent ignition within the conduit or abnormal combustion with gaseous oxygen supplied, the oxygen conduit is desirably made of Cr stainless steels having great resistance to oxidation at high temperatures. A typical example of the lance construction is illustrated in FIGS. 2 and 3, wherein the gaseous oxygen is fed through an inner tube 4, and a protective coolant such as a gaseous material (e.g. $N_2$, $CO_2$, Ar, $CH_4$ and $C_3H_8$), or a liquid material (e.g. kerosine) is fed through the space between the inner tube and an outer tube 5. In FIGS. 2 and 3, the castable refractory is indicated by the numeral 6. The lance preferably has a sheathed nozzle so that a coolant can be fed simultaneously with oxygen to prevent erosion of the nozzle, but a single-walled nozzle may also be used. A nozzle with a "straight" opening is generally preferred since it is easy to fabricate and serves all purposes, but to minimize the nozzle erosion due to the ascending of the injected oxygen, a nozzle of "inverted T shape" with openings in diametric positions may be used. The lance may have any shape and dimensions so long as gaseous oxygen can be blown into the molten iron through it. The foregoing description assumes the only use of an immersed lance as means through which to inject gaseous oxygen into the molten iron, but the advantages of the prevent invention can be achieved by using a tuyere positioned in the bottom or the side wall in the lower part of the vessel, provided that the requirements mentioned above are met. One embodiment of the present invention is illustrated in FIG. 1 wherein gaseous oxygen is supplied to the molten iron through an immersed lance 4 and an agitating gas through a tuyere 3 provided in the bottom of a ladle 2.

The gas used as a protective coolant to protect the nozzle is generally fed in an amount of 5 to 30 vol% of the gaseous oxygen. The gaseous oxygen and coolant gas are fed to the molten iron through a sheathed pipe separately or through a single-walled pipe in admixture. The coolant gas and gaseous oxygen supplied provide the molten iron with the energy for agitating it. The agitating energy is largely determined by the rate of the gas feed. The rate of gaseous oxygen feed ($V_{O2}$) is determined as described hereinabove, and the coolant gas is fed in an amount of 5 to 30% of the so determined oxygen feed rate. Since the $V_{O2}$ is decreased as the Si content of the molten iron is reduced, the molten iron with low Si content is given insufficient agitating energy. To prevent this, the molten iron with low Si content is preferably supplied with more coolant gas per gaseous oxygen than the iron with high Si content. To provide more agitating energy for the molten iron with low Si content is important for letting the blown oxygen diffuse into the molten iron quickly, increasing the change of reaction between silicon and oxygen and accelerating the desired preferential desiliconization. When gaseous oxygen is injected into the molten iron together with the coolant gas, the oxygen utilization in preferential desiliconization can be increased further by supplementing the agitating energy of the gases with that of a mechanical means such as an impeller. Stated conversely, the rate of gaseous oxygen feed ($V_{O2}$) can be increased for achieving a predetermined oxygen utilization in preferential desiliconization. The energy for agitating the molten iron may also be provided by supplying a neutral or inert gas (e.g. $N_2$, $CO_2$ or Ar) from below through a porous refractory embedded in the bottom or the lower part of the side wall of the vessel. This method is effective for accelerating the desired desiliconization.

As described in the foregoing, the present invention is capable of desiliconizing molten iron efficiently by using gaseous oxygen. According to the present invention, molten iron in a ladle or other melt conveyors can be desiliconized with gaseous oxygen without causing boiling or other unwanted effects. Throughout the operation, the oxygen utilization in preferential desiliconization can be held at 40% or more. Furthermore, the invention can achieve better heat control and selection of input charges in the overall steelmaking process. For these reasons, the present invention will prove very useful to the steelmaking industry.

As still another advantage, the present invention is particularly effective for desiliconizing molten iron with high Si content. To make most of the metallurgical effects of preliminary desiliconization in steelmaking, the silicon content of the molten iron must be 0.20% or less after the desiliconization. The higher the Si content of the molten iron before desiliconization, the more the silicon that is removed, but if solid iron oxides such as mill scale are used as a desiliconizing agent, the temperature of the molten iron drops very rapidly to cause insufficiency in the heat source necessary for the subsequent steps. But in the method of the present invention which uses gaseous oxygen, there is no such temperature drop and the defects of the conventional technique are completely eliminated. Therefore, the technical advantages of the present invention are particularly great if it is used to desiliconize molten iron with high Si content.

TABLE 1-1

| Run No. | Classification | Molten iron (tons) | | Composition (wt %) C | Si | Mn | P | S | Temperature of the melt (°C.) | $V_{O_2}$ ($Nm^3$/min/t · p) | Coolant |
|---|---|---|---|---|---|---|---|---|---|---|---|
| 1 | The present invention 1 | 65 | before treatment | 4.53 | 0.31 | 0.50 | 0.112 | 0.032 | 1350 | 0.15 | none |
| | | | after treatment | 4.45 | 0.09 | 0.43 | 0.112 | 0.032 | ↓ 1400 | | |
| 2 | The present invention 2 | 66 | before treatment | 4.50 | 0.59 | 0.50 | 0.113 | 0.028 | 1360 | 0.25 | none |
| | | | after treatment | 4.40 | 0.12 | 0.40 | 0.113 | 0.027 | ↓ 1480 | | |
| 3 | The present invention 3 | 65 | before treatment | 4.57 | 1.13 | 0.48 | 0.115 | 0.024 | 1380 | 0.80 | none |
| | | | after treatment | 4.40 | 0.12 | 0.35 | 0.114 | 0.024 | ↓ 1560 | | |
| 4 | The present invention 4 | 67 | before treatment | 4.55 | 0.60 | 0.49 | 0.109 | 0.029 | 1350 | 0.25 | none |
| | | | after treatment | 4.43 | 0.10 | 0.39 | 0.109 | 0.029 | ↓ 1460 | | |
| 5 | The present invention 5 | 65 | before treatment | 4.53 | 0.55 | 0.52 | 0.111 | 0.032 | 1360 | 0.25 | none |
| | | | after treatment | 4.49 | 0.08 | 0.46 | 0.110 | 0.031 | ↓ 1460 | | |
| 6 | The present invention 6 | 67 | before treatment | 4.52 | 0.80 | 0.49 | 0.115 | 0.025 | 1365 | 0.63 | none |
| | | | after treatment | 4.39 | 0.11 | 0.36 | 0.115 | 0.025 | ↓ 1530 | | |
| 7 | The present invention 7 | 63 | before treatment | 4.50 | 0.82 | 0.53 | 0.108 | 0.030 | 1350 | 0.10 | none |
| | | | after treatment | 4.48 | 0.12 | 0.44 | 0.108 | 0.030 | ↓ 1510 | | |
| 8 | The present invention 8 | 65 | before treatment | 4.50 | 0.62 | 0.50 | 0.110 | 0.031 | 1360 | 0.25 | none |
| | | | after treatment | 4.44 | 0.09 | 0.43 | 0.110 | 0.031 | ↓ 1480 | | |
| 9 | The present invention 9 | 66 | before treatment | 4.53 | 0.59 | 0.51 | 0.113 | 0.029 | 1365 | 0.25 | none |
| | | | after treatment | 4.47 | 0.08 | 0.43 | 0.112 | 0.029 | ↓ 1490 | | |
| 10 | The present invention 10 | 64 | before treatment | 4.55 | 0.66 | 0.51 | 0.110 | 0.032 | 1360 | 0.10 | iron sand 1,500 kg |
| | | | after treatment | 4.50 | 0.11 | 0.36 | 0.110 | 0.032 | ↓ 1365 | | |
| 11 | The present invention 11 | 65 | before treatment | 4.52 | 0.63 | 0.50 | 0.114 | 0.027 | 1350 | 0.25 | lime stone 300 kg |
| | | | after treatment | 4.46 | 0.12 | 0.36 | 0.113 | 0.027 | ↓ 1375 | | |
| 12 | The present invention 12 | 63 | before treatment | 4.50 | 0.59 | 0.49 | 0.107 | 0.031 | 1350 | 0.26 | none |
| | | | after treatment | 4.41 | 0.09 | 0.39 | 0.107 | 0.031 | ↓ 1460 | | |
| 13 | The present invention 13 | 66 | before treatment | 4.46 | 0.58 | 0.51 | 0.110 | 0.029 | 1360 | 0.24 | none |
| | | | after treatment | 4.40 | 0.10 | 0.43 | 0.110 | 0.028 | ↓ 1440 | | |
| 14 | The present invention 14 | 65 | before treatment | 4.53 | 0.62 | 0.52 | 0.110 | 0.033 | 1360 | 0.30 | none |
| | | | after treatment | 4.37 | 0.11 | 0.47 | 0.109 | 0.033 | ↓ 1430 | | |

| Run No. | Duration of treatment (min) | Lance immersion depth (mm) | Protective coolant gas and its supply rate with respect to oxygen injecting rate (vol %) | Agitating gas and its supply rate with respect to oxygen injecting rate (vol %) | Mechanical agitation | Undesired effects: Boiling | Undesired effects: Others |
|---|---|---|---|---|---|---|---|
| 1 | 27 | 1,000 | $N_2$, 30% | none | none | none | |
| 2 | 30 | 1,000 | $N_2$, 25% | none | none | none | |
| 3 | 35 | 1,000 | $N_2$, 20% | none | none | none | |
| 4 | 31 | 500 | $N_2$, 25% | none | none | none | |
| 5 | 28 | 1,500 | $N_2$, 25% | none | none | none | |

TABLE 1-1-continued

| | | | | | | |
|---|---|---|---|---|---|---|
| 6 | 25 | 1,000 | $N_2$, 25% | none | none | none |
| 7 | 110 | 1,000 | $N_2$, 30% | none | none | none |
| 8 | 29 | 1,000 | $N_2$, 25% | $N_2$, 10% | none | none |
| 9 | 28 | 1,000 | $N_2$, | none | impeller 120 r.p.m. | none |
| 10 | 27 | 1,000 | $N_2$, 25% | none | none | none |
| 11 | 29 | 1,000 | $N_2$, 25% | none | none | none |
| 12 | 30 | 1,000 | $CO_2$, 20% | none | none | none |
| 13 | 31 | 1,000 | $N_2$, 10% $C_3H_8$, 5% | none | none | none |
| 14 | 30 | 300 | none | $N_2$, 25% | none | none |

TABLE 1-2

| Run No. | Classification | Molten iron (tons) | | Composition (wt %) C | Si | Mn | P | S | Temperature of the melt (°C.) | $V_{O_2}$ ($Nm^3$/min/t · p) | Coolant |
|---|---|---|---|---|---|---|---|---|---|---|---|
| 15 | The present invention 15 | 66 | before treatment I | 4.47 | 0.83 | 0.52 | 0.110 | 0.031 | 1350 | 0.58 | none |
| | | | after treatment I | | | | | | | | |
| | | | before treatment II | 4.44 | 0.52 | 0.49 | 0.110 | 0.030 | 1400 | 0.25 | none |
| | | | after treatment II | | | | | | | | |
| | | | before treatment III | 4.39 | 0.31 | 0.45 | 0.110 | 0.030 | 1460 | 0.15 | none |
| | | | after treatment III | 4.43 | 0.10 | 0.41 | 0.110 | 0.030 | 1520 | | |
| 16 | The present invention 16 | 65 | before treatment I | 4.50 | 0.80 | 0.50 | 0.109 | 0.029 | 1350 | 0.57 | none |
| | | | after treatment I | | | | | | | | |
| | | | before treatment II | 4.47 | 0.50 | 0.48 | 0.109 | 0.029 | 1410 | 0.26 | none |
| | | | after treatment II | | | | | | | | |
| | | | before treatment III | 4.41 | 0.29 | 0.45 | 0.109 | 0.029 | 1470 | 0.15 | none |
| | | | after treatment III | 4.38 | 0.08 | 0.43 | 0.109 | 0.029 | 1500 | | |
| 17 | The present invention 17 | 67 | before treatment | 4.53 | 0.65 | 0.52 | 0.112 | 0.027 | 1370 | 0.5 ↓ | none |
| | | | after treatment | 4.45 | 0.10 | 0.43 | 0.112 | 0.027 | 1460 | 0.1 | |

| Run No. | Classification | Molten iron (tons) | | Composition (wt %) C | Si | Mn | P | S | Temperature of the melt (°C.) | $V_{O_2}$ ($Nm^3$/min/ton) | Coolant |
|---|---|---|---|---|---|---|---|---|---|---|---|
| 18 | Comparative method 1 | 65 | before treatment | 4.50 | 0.58 | 0.52 | 0.113 | 0.028 | 1365 | 0.02 | none |
| | | | after treatment | 4.46 | 0.50 | 0.50 | 0.113 | 0.028 | 1375 | | |
| 19 | Comparative method 2 | 65 | before treatment | 4.47 | 0.59 | 0.50 | 0.112 | 0.029 | 1370 | 0.81 | none |
| | | | after treatment | 4.03 | 0.13 | 0.39 | 0.112 | 0.029 | 1450 | | |
| 20 | Conventional method 1 | 66 | before treatment | 4.52 | 0.60 | 0.51 | 0.110 | 0.030 | 1365 | blown onto the melt 0.4 | none |
| | | | after treatment | 4.15 | 0.13 | 0.33 | 0.110 | 0.030 | 1400 | | |
| 21 | Conventional method 2 | 66 | before treatment | 4.52 | 0.59 | 0.50 | 0.109 | 0.027 | 1360 | mill scale added in 2.5 kg/min/t · p | |
| | | | after treatment | 4.47 | 0.12 | 0.30 | 0.109 | 0.027 | 1325 | | |

(1) In Run No. 14, the consumable lance was immersed to a depth of 300 mm by descending it at a rate of 100 mm/min.
(2) In Run Nos. 15 and 16, treatments I, II and III were successive.

| Run No. | Duration of treatment (min) | Lance immersion depth (mm) | Protective coolant gas and its supply rate with respect to oxygen injecting rate (vol %) | Agitating gas and its supply rate with respect to oxygen injecting rate (vol %) | Mechanical agitation | Undesired effects Boiling | Others |
|---|---|---|---|---|---|---|---|
| 15 | 8 | 1,000 | $N_2$, 25% | none | none | none | |
| | 13 | 1,000 | $N_2$, 25% | none | none | none | |
| | 25 | 1,000 | $N_2$, 25% | none | none | none | |
| 16 | 9 | 1,000 | $N_2$, 20% | none | none | none | |
| | 13 | 1,000 | $N_2$, 25% | none | none | none | |
| | 23 | 1,000 | $N_2$, 30% | none | none | none | |
| 17 | 25 | 1,000 | $N_2$, 25% | none | none | none | |
| 18 | 50 | 1,000 | $N_2$, 30% | none | none | none | operation interrupted |

TABLE 1-2-continued

| | | | | | | | |
|---|---|---|---|---|---|---|---|
| | | | | | | | 50 min. later due to nozzle clogging |
| 19 | 15 | 1,000 | $N_2$, 20% | none | none | maximum | slopping significant |
| 20 | 38 | | | $N_2$ blown from the bottom in 0.05 $Nm^3$/min/t · p. | none | a little | |
| 21 | 12 | | | none | impeller 120 r.p.m. | none | |

As is clear from Table 1 which lists the data on desiliconization by the method of the present invention, comparative method or the conventional method, the present invention achieves efficient preferential desiliconization of molten iron. The present invention also eliminates the defects of the conventional method of desiliconizing molten iron by feeding solid iron oxides or gaseous oxygen. In consequence, the present invention accomplishes more efficient desiliconization of molten iron and achieves better heat control and selection of input charges in the overall steelmaking process. Hence, the invention will prove very useful to the steelmaking industry.

What is claimed is:

1. A method of preferential desiliconization of molten iron by injecting gaseous oxygen wherein the gaseous oxygen is injected into the molten iron at controlled a rate depending upon the silicon content of the molten iron so as to satisfy the formula (I):

$$0.03 \leqq V_{O2} \leqq 1.25\ [\%Si] - 0.075 \quad (I)$$

wherein $V_{O2}$: the rate of gaseous oxygen feed $Nm^3$/min/ton pig,) and [%Si]: Si content of the molten iron (%).

2. The method according to claim 1 wherein the rate of gaseous oxygen feed $V_{O2}$ is controlled depending upon the silicon content of the molten iron so as to satisfy the formulae (II) and (III):

$$0.03 \leqq V_{O2} \leqq 0.80\ [\%Si] - 0.075 \quad (II)$$

$$V_{O2} \geqq 0.16\ [\%Si] - 0.01\ 0.03 \geqq \quad (III)$$

3. A method according to claim 1 or 2 wherein the rate of gaseous oxygen feed $V_{O2}$ is reduced stepwise or continuously.

4. The method according to claim 1 wherein the gaseous oxygen is supplied through a lance immersed in the molten iron to a depth of at least 200 mm.

5. The method according to claim 4 wherein the gaseous oxygen is supplied through a consumable lance.

6. The method according to any one of claims 4 or 5 wherein the energy for agitating the molten iron is controlled by varying the amount of a protective coolant that is used to protect the immersed lance from elevated temperatures.

7. The method according to claim 6 wherein an agitating gas is mixed with the gaseous oxygen supplied for desiliconization.

8. The method according to claim 7 wherein the agitating gas is injected from the bottom and/or side of a container which contains the molten iron being desiliconized.

9. The method according to claim 8 wherein the energy of mechanical agitation is used to further increase the oxygen utilization in preferential desiliconization.

10. The method according to claim 1 wherein a coolant is used to control the temperature of the molten iron being desiliconized.

11. The method according to claim 10 wherein solid iron oxide is used as the coolant.

* * * * *

UNITED STATES PATENT AND TRADEMARK OFFICE

CERTIFICATE OF CORRECTION

PATENT NO. : 4,394,165

DATED : July 19, 1983

INVENTOR(S) : SHINGO SATOH, TAKASHI INOUE, MINORU NAKI and YUJI KAWAUCHI

It is certified that error appears in the above—identified patent and that said Letters Patent is hereby corrected as shown below:

Column 13, line 27, change "controlled a" to -- a controlled --;

Column 13, line 34, change "$Nm^3$/min/ton pig,)" to -- ($Nm^3$/min/ton pig), --;

Column 14, line 10, change "$V_{O_2} \geqq 0.16[\%Si]-0.01\ 0.03 \geqq$" to -- $V_{O_2} \geqq 0.16[\%Si]-0.01 \geqq 0.03$ --;

Column 14, line 12, change "A" to -- The --.

Signed and Sealed this

Seventeenth Day of January 1984

[SEAL]

Attest:

GERALD J. MOSSINGHOFF

Attesting Officer

Commissioner of Patents and Trademarks